United States Patent [19]

Marozzi

[11] 4,023,490

[45] May 17, 1977

[54] ROTARY IMPRINTING APPARATUS

[76] Inventor: Alfred A. Marozzi, 3 Cheryl Place, Pine Brook, N.J. 07058

[22] Filed: Aug. 14, 1975

[21] Appl. No.: 604,824

[52] U.S. Cl. ..... 101/235; 34/155; 101/328; 101/352; 101/219

[51] Int. Cl.[2] ..... B41J 3/64; B41J 3/56

[58] Field of Search ..... 34/155; 101/216, 219, 101/233–235, 327–330, 416, 352, 353, 351

[56] References Cited

UNITED STATES PATENTS

| | | | |
|---|---|---|---|
| 2,761,379 | 9/1956 | Hirschey et al. | 101/233 |
| 3,008,408 | 11/1961 | Knops et al. | 101/252 |
| 3,037,447 | 6/1962 | Gonzalez et al. | 101/235 |
| 3,063,369 | 11/1962 | Timson | 101/416 R |
| 3,097,599 | 7/1963 | Rutishanser | 101/416 R |
| 3,208,375 | 9/1965 | Worth | 101/35 |
| 3,418,934 | 12/1968 | Rannier | 101/328 |
| 3,487,776 | 1/1970 | Marozzi | 101/245 |
| 3,538,834 | 11/1970 | Yamagata et al. | 34/155 |
| 3,724,369 | 4/1973 | Gery et al. | 101/327 |

*Primary Examiner*—Clifford D. Crowder
*Assistant Examiner*—William Pieprz
*Attorney, Agent, or Firm*—Clarence A. O'Brien; Harvey B. Jacobson

[57] ABSTRACT

A moving web is marked at spaced locations by a rotatable print head that is intermittently displaced into contact with the web during angular displacement between two rest positions by means of a signal controlled clutch drivingly connecting the print head to a driver driven by the movement of the web. In the rest positions of the print head, a print face is momentarily engaged by an ink storing device that is displaced from a retracted position.

18 Claims, 11 Drawing Figures

ROTARY IMPRINTING APPARATUS

BACKGROUND OF THE INVENTION

This invention relates to the marking of surfaces such as packaging film by signal controlled marking apparatus utilizing ink as the marking medium.

Signal controlled apparatus for marking a traveling web of material is disclosed in my prior U.S. Pat. No. 3,487,776. In this type of apparatus, the traveling web is engaged by a friction driver wheel that is intermittently loaded under control of a signal operated clutch to rotate a printing wheel for marking the traveling web at spaced locations. The print face on the printing wheel while spaced from the traveling web, has ink transferred thereto from an ink storing device. One of the drawbacks associated with the aforementioned marking apparatus resides in the tendency of the web to rupture because of excessive drive pressure exerted thereon by prolonged contact between the web and the friction driver for the rotary printing wheel. Further, engagement of the printing wheel by the ink storing device through which ink is transferred to the printing wheel, imposes a constant drag and that not only requires increased contact pressure on the moving web but also results in excessive wear on the print face.

A web driven, rotary marking device of the aforementioned type is also disclosed in my prior U.S. Pat. No. 3,666,682 employing a replaceable ink cartridge type of ink storing device. The latter type of marking device suffers from the same drawbacks however, as aforementioned.

Replaceable cartridge types of ink storing devices are also disclosed in prior U.S. Pat. Nos. 3,797,390 and 3,804,016 owned in common with the previously mentioned patents. In the latter two mentioned patents, a print head is displaced between a marking position and a rest position with the ink storing device engaging the marking device only in the rest position. However, the print face in its rest position is continuously engaged by the ink storing device.

It is therefore an important object of the present invention to provide a signal operated marking apparatus for a traveling web utilizing a rotatable web driven print head for rapid and automatic operation wherein the aforementioned drawbacks of prior patented marking apparatus are avoided. An additional object of the present invention is to provide a marking device which not only avoids the undesirable features aforementioned in connection with applicant's prior patented devices but also combines the various beneficial features of such prior patented devices in a compatible manner including a rotary print head under signal operated clutch control driven by the traveling web and a replaceable cartridge type of ink storing device that is slidably mounted by the frame of the marking device.

SUMMARY OF THE INVENTION

In accordance with the present invention, a rotatable marking element is provided with at least two print face segments angularly spaced apart and displaced during each operational cycle between one of two rest positions in which one of the print faces is momentarily engaged by a slidable cartridge type of ink storing device The ink storing device is ordinarily held retracted so as not to impose any drag on the marking element while it is angularly displaced between said rest positions for momentary contact with a traveling web.

Thus, loading of the web by both the print head and the ink storing device simultaneously is avoided. The motion of the web is intermittently transferred to the rotary marking element for this purpose under control of a signal operated clutch. Displacement of the ink storing cartridge independently of the print head into momentary wiping contact with the print face is also signal controlled and synchronized with intermittent angular displacement of the rotatable marking element which is thereby arranged to effect marking of the traveling web at predetermined spaced locations in the direction of travel.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
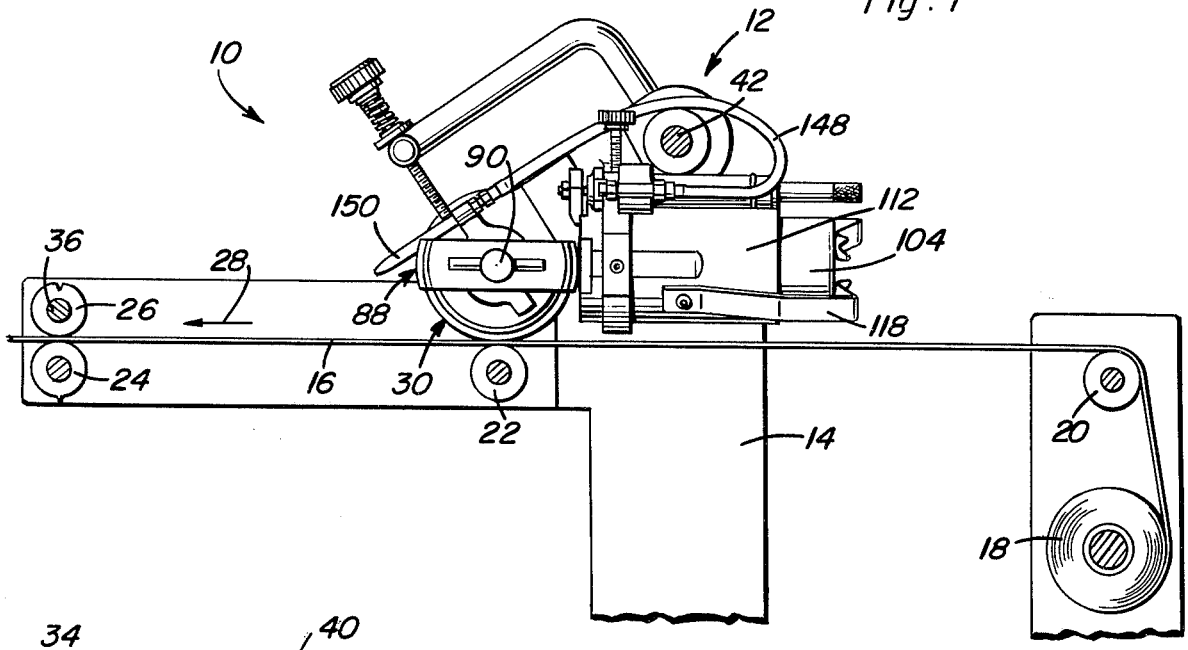
FIG. 1 is a side elevational view of the marking apparatus of the present invention in a typical installation.

Referring now to the drawings in detail, FIG. 1 illustrates a typical marking installation generally referred to by reference numeral 10 wherein the marking apparatus of the present invention generally denoted by reference numeral 12 is mounted on a frame 14 in operative relationship to a traveling web 16. The web which is in the form of a packaging film, on which certain information is to be marked, is withdrawn from a storage roll 18 and is entrained over a guide roller 20 aligned with a pressure roller 22 through which the web is driven toward a pair of cutoff rollers 24 and 26 in the direction of travel as indicated by arrow 28. The web is held in engagement with the pressure driving roller 22 by a friction driver wheel 30 associated with the marking apparatus 12.

Figure 2:
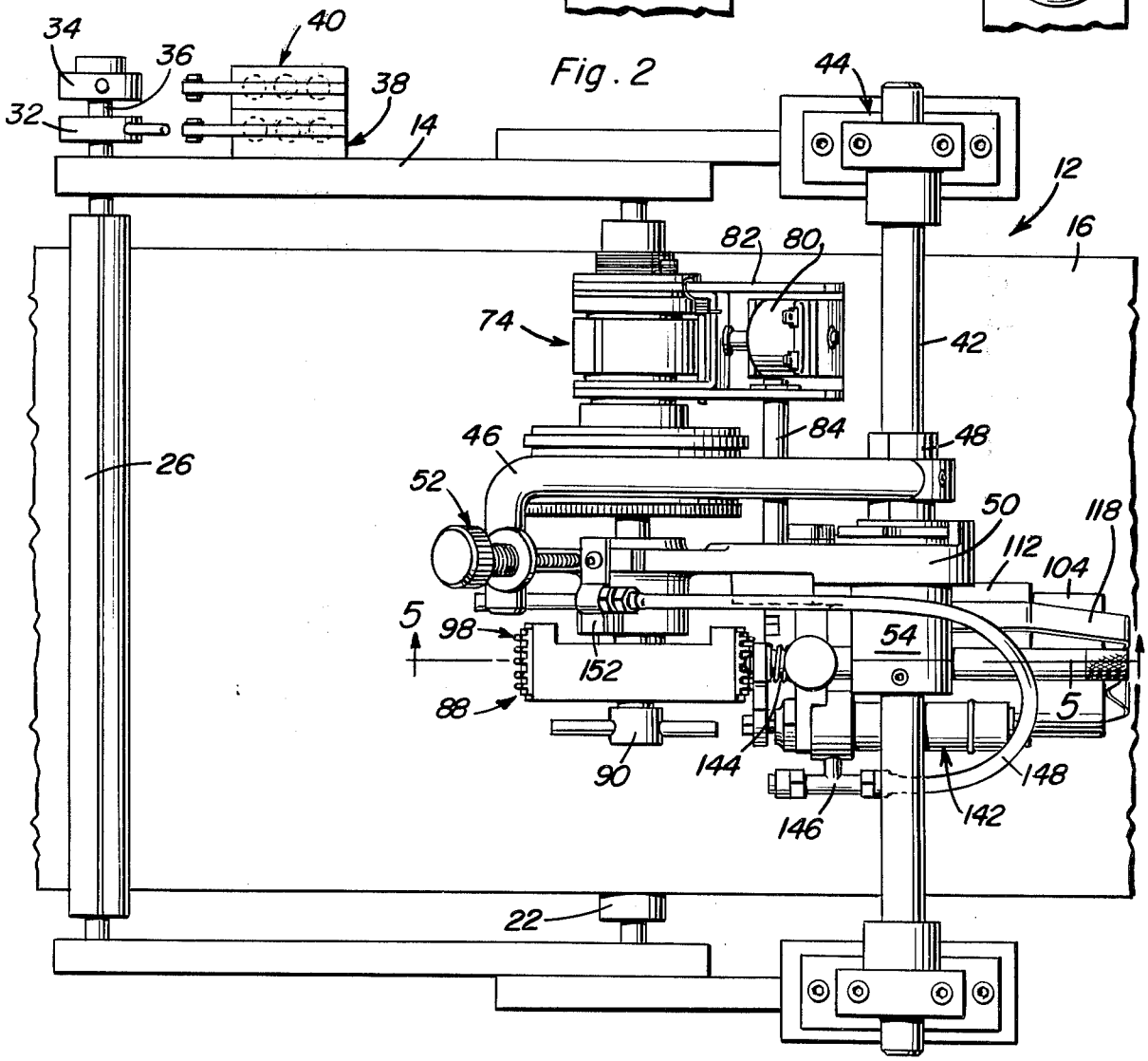
FIG. 2 is a top plan view of the marking apparatus shown in FIG. 1.
Figure 3:
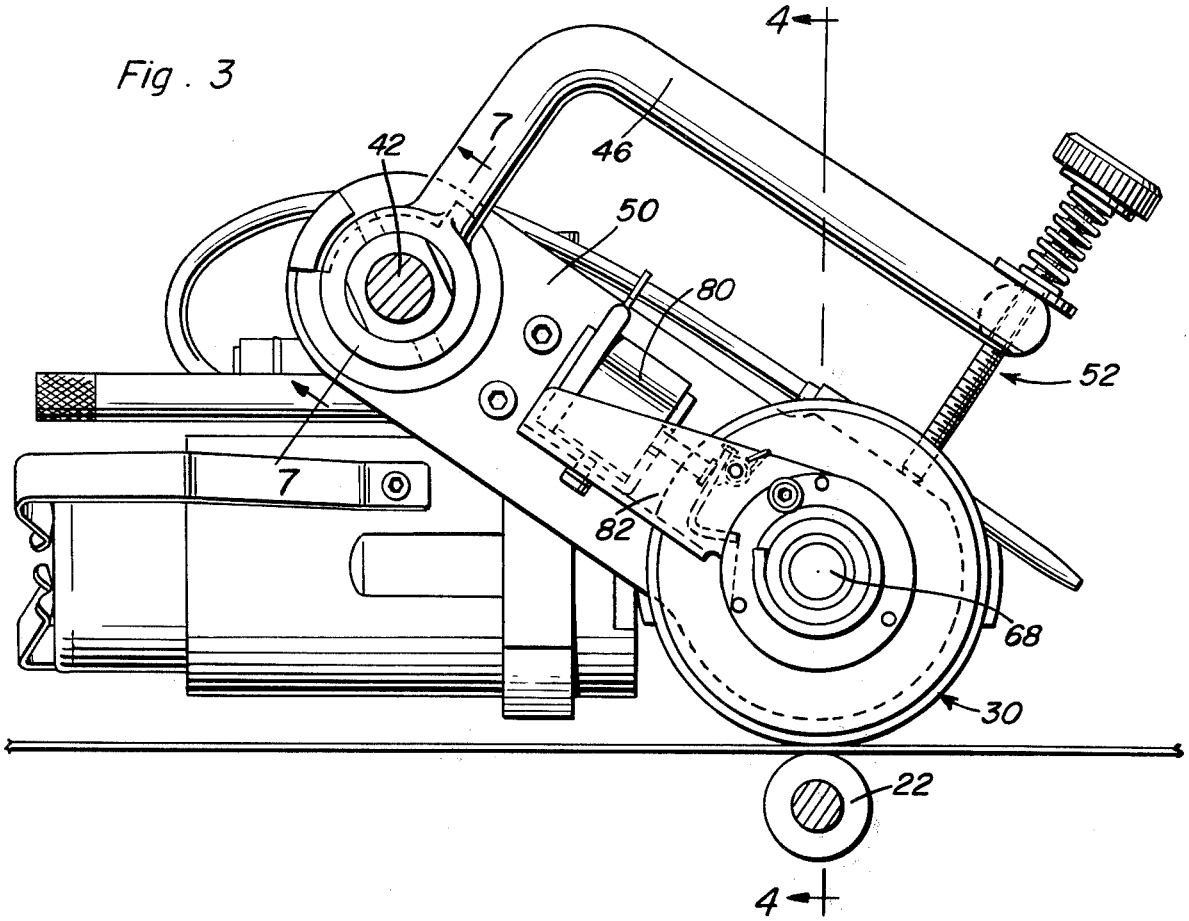
FIG. 3 is an enlarged side elevational view of the marking apparatus as viewed from a side opposite to that shown in FIG. 1.

With reference to FIGS. 1 and 2, the traveling web 16 may be continuously or intermittently advanced by powering of the cutoff rollers 26 and 24 rotatably mounted by the frame 14 at a location downstream of the marking apparatus 12. Operation of the marking apparatus is synchronized with the movement of the web 16 as will be explained hereafter under control of a pair of cams 32 and 34 connected to an extension of the shaft 36 associated with the cutoff roller 26. Control switches 38 and 40 are respectively actuated in proper sequence by the cams 32 and 34 in order to establish signal pulses through which the marking apparatus is controlled, in order to place marks at predetermined spaced locations on the web 16.

Figure 7:
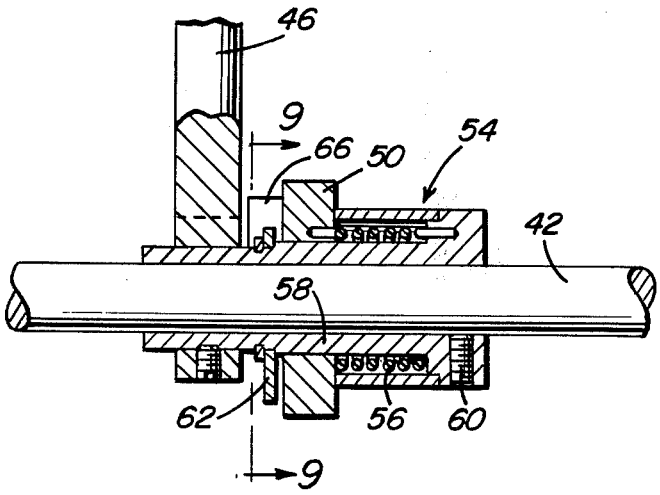
FIG. 7 is a partial sectional view taken substantially through a plane indicated by section line 7—7 in FIG. 3.
Figure 9:
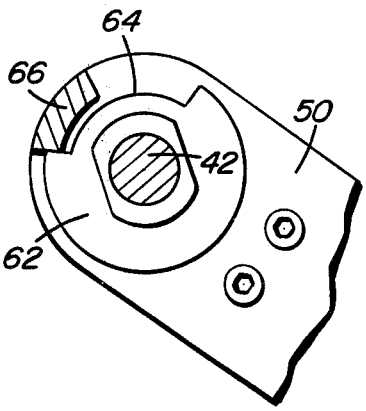
FIG. 9 is a partial sectional view taken substantially through a plane indicated by section line 9—9 in FIG. 7.

As more clearly seen in FIG. 2, a fixed pivot shaft 42 is secured adjacent its opposite longitudinal ends to the frame 14 by anchor assemblies 44 to establish a pivotal axis at right angles to the direction of travel of the web 16 underlying the pivot shaft. A holder bracket 46 is secured to the fixed pivot shaft by a hub 48. A pivotal carrier arm 50 is rotatably mounted on the pivot shaft 42 in close axial spaced relationship to the bracket 46. A spring-biased adjustment device 52 mounted at the end of the bracket 46 remote from the pivot shaft 42, engages the carrier arm 50 in order to position the driver wheel 30 in a web engaging position against a spring-bias. The spring-bias is established by a spring device generally referred to by reference numeral 54 as more clearly seen in FIG. 7. The spring device 54 includes a coil spring element 56 anchored at one end to the carrier arm 50 and at its other end to a tubular sleeve 58 secured to the fixed pivot shaft 42 by a setscrew 60. Secured to the sleeve 58 adjacent to the carrier arm 50 is a limit stop disc 62 which is provided with an arcuate recess 64 as more clearly seen in FIG. 9 engageable with a stop element 66 projecting axially from the carrier arm 50. Thus, angular displacement of the carrier arm 50 relative to the fixed pivot shaft 42 is confined to a limited arc and within this limited range of movement, the carrier arm is held in an angularly adjusted position by the manual adjustment device 52 against the bias of the coil spring 56 in order to establish a predetermined contact pressure between the web 16 and the friction drive wheel 30 which is rotatably mounted adjacent the remote end of the carrier arm 50 by a shaft 68. As more clearly seen in FIG. 4, the shaft 68 is rotatably carried by an axially extending hub portion 70 at the free end of the arm 50 within which a pair of spaced bearing assemblies 72 are carried for journaling the shaft 68.

Figure 4:
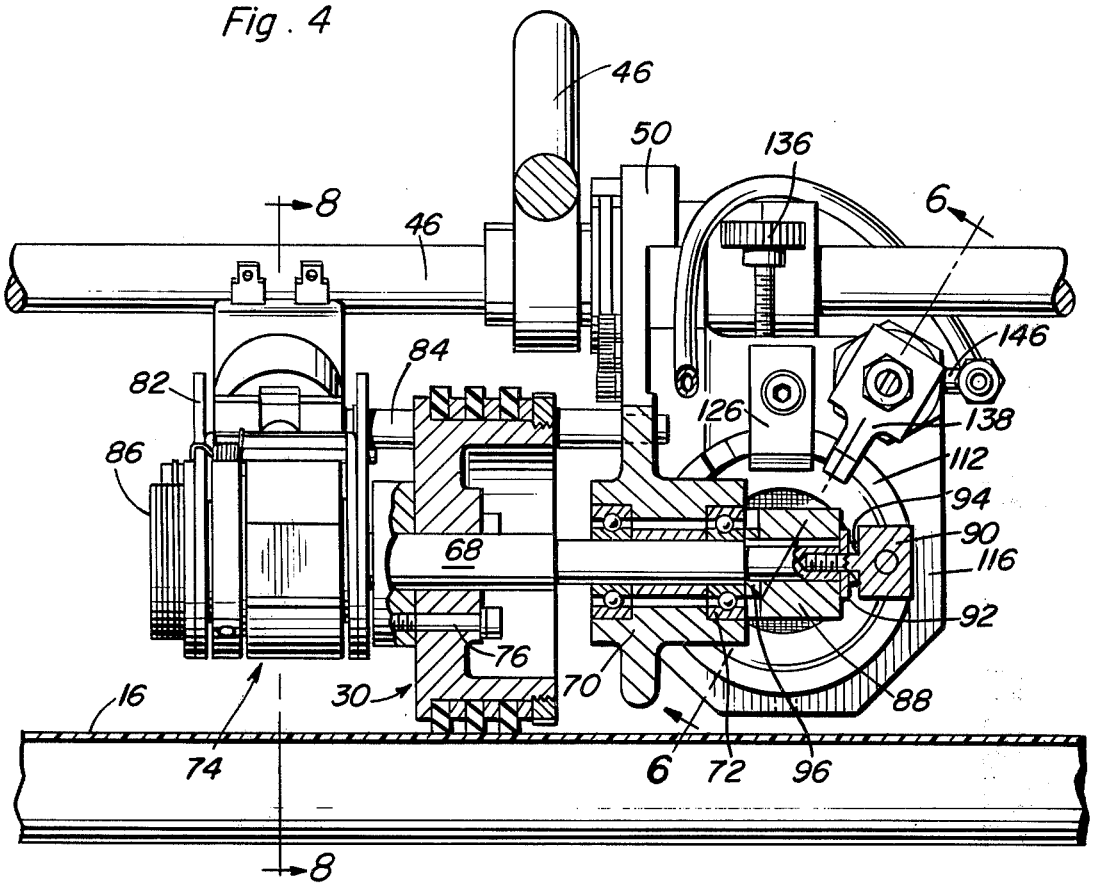
FIG. 4 is a sectional view taken substantially through a plane indicated by section line 4—4 in FIG. 3.
Figure 8:
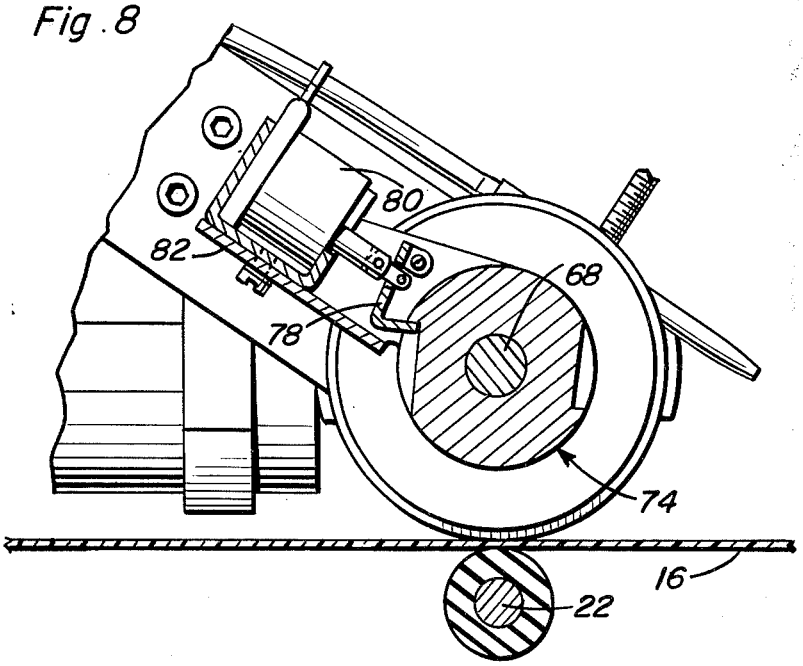
FIG. 8 is a partial sectional view taken substantially through a plane indicated by section line 8—8 in FIG. 4.

As more clearly seen in FIG. 4, the friction drive wheel 30 is loosely mounted on the shaft 68 and is adapted to be coupled thereto during limited web-loading intervals by means of a signal controlled clutch mechanism generally referred to by reference numeral 74, to which the friction drive wheel is connected by means of fasteners 76. The clutch mechanism 74 is of a commercially available type adapted to couple the friction drive wheel 30 to the shaft 68 for angular displacement through an arc of 180°. Such clutch devices are known as half-revolution clutches and are adapted to be actuated in response to retraction of a latch element 78 by pulsing of an actuating solenoid 80 as more clearly seen in FIG. 8. The actuating solenoid 80 is carried by an arm 82 rotatably mounted on the shaft 68 and secured to the carrier arm 50 by means of a connecting shaft 84. An axial thrust assembly 86 is secured to the shaft 68 at one axial end in abutment with the control arm 82 of the clutch mechanism while the other axial end of the shaft 68 has a rotatable marking element 88 keyed thereto and axially retained thereon by means of an assembly screw element 90 spaced from the rotatable marking element by a washer 92 and spacer 94 as more clearly seen in FIG. 4. A spacer 96 axially spaces the rotatable marking element 88 from the hub portion 70 of the carrier arm 50.

Figure 5:
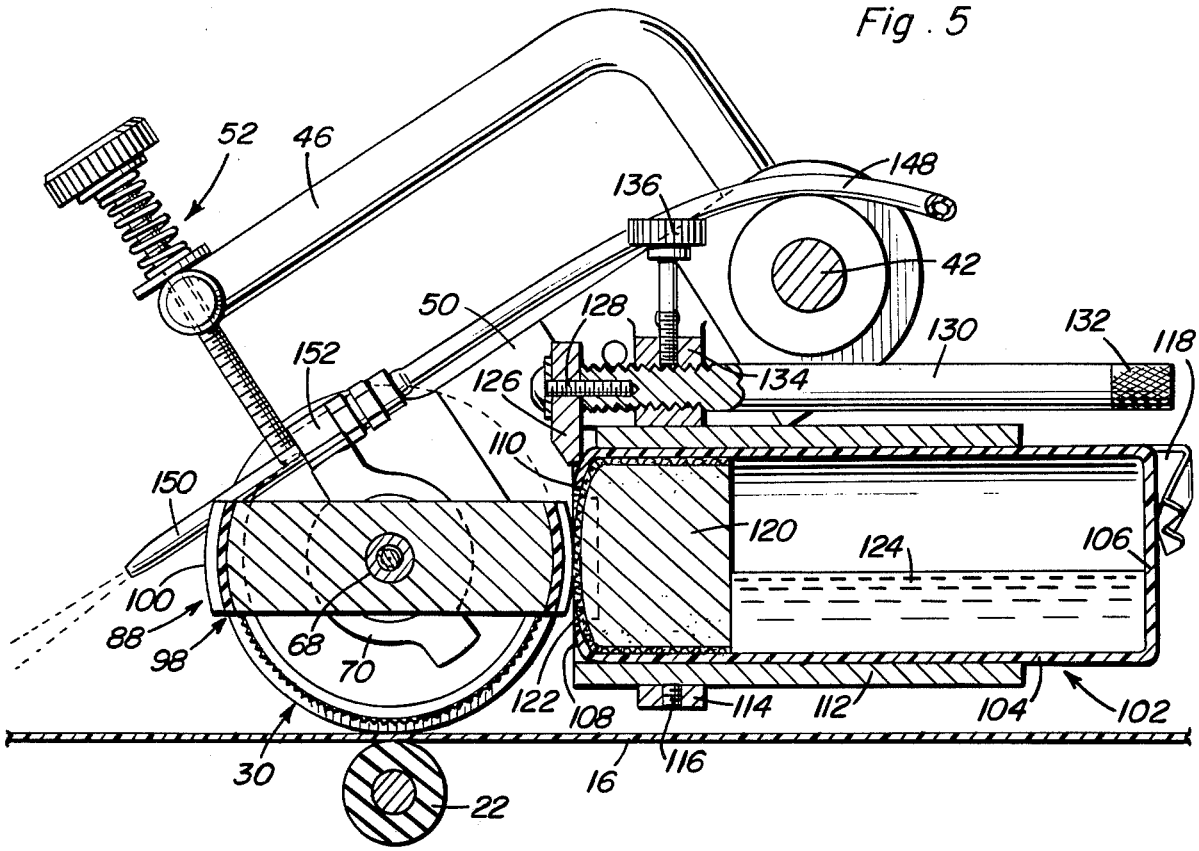
FIG. 5 is a section view taken substantially through a plane indicated by section line 5—5 in FIG. 2.

As more clearly seen in FIG. 5, the rotatable marking element 88 which is secured to the driven shaft 68 and rotated thereby when it is coupled to the drive wheel 30 by the clutch mechanism 74, is provided with a pair of arcuate print head segments 98 from which print faces 100 project for marking of the web 16 with ink in response to momentary contact of the print face with the web. The two print heads 98 are angularly spaced from each other on the marking element 88 by 180°, the marking element being normally held in a rest position as shown in FIG. 5 substantially parallel to the web 16. The marking element is intermittently rotated through a predetermined path such as a 180° arc during the limited web-loading phase of the marking cycle by engagement of the clutch mechanism 74 in response to a signal applied to the clutch actuating solenoid 80. When angularly displaced through the 180° arc, one of the print heads 98 on the rotatable marking element momentarily contacts the web to perform the marking operation. The rotatable marking element is however normally held stationary in its rest position as shown in FIG. 5 between marking cycles. During the stationary rest periods, one or the other of the two print heads 98 is positioned in alignment with an ink storing device generally referred to by reference numeral 102 through which ink is transferred to the print face 100 prior to its angular displacement.

With continued reference to FIG. 5, the ink storing device includes a tubular cartridge housing 104 closed at one axial end by a wall 106 while the other axial end is provided with a wall 108 having a central opening 110 formed therein. The ink storing cartridge housing 104 is slidably mounted by a tubular guide 112 secured to a bracket 114 by means of a setscrew 116, the bracket projecting from the carrier arm 50. Leaf spring elements 118 secured to the tubular guide 112, engage the end wall 106 of the cartridge housing 104 in order to axially bias the housing in a direction toward the rotatable marking element 88. An absorbent filler body 120 covered by gauze 122 is exposed through the central opening 110 in the end wall 108 of the housing 104. The filler body 120 thus retains a body of liquid ink 124 within the housing 104 and acts to transfer such ink by capillary action to the print faces 100 when in contact with the filler body through the opening 110. The springs 118 axially bias the housing 104 toward an extended position in order to establish contact with a print face. The extended position is determined by a limit stop 126 secured by fastener 128 to a threaded end portion of an adjustment rod 130. The other end of the adjustment rod 130 is provided with a knurled surface 132 so that it may be manually rotated in order to effect axial movement thereof to change the adjusted position of the limit stop 126. The threaded end portion of the adjustment rod is therefore threadedly received within an internally threaded nut portion 134 of the bracket 114. The adjustment rod 130 is releasably held in its axially adjusted position by means of an adjustment lock screw 136. The limit stop 126 is positioned by its adjustment rod 130 in radially overlapping relationship to the tubular guide 112 as more clearly seen in FIG. 4. Also positioned in radial relationship to the tubular guide 112 at the same axial end as the limit stop 126, is a retracting element 138 adapted to engage the end wall 108 of the housing for axial displacement thereof to a retracted position against the bias of the springs 118.

Figure 6:
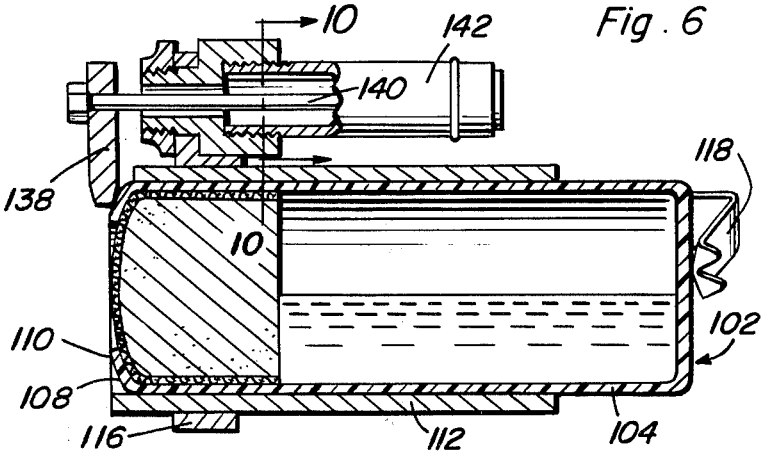
FIG. 6 is a partial sectional view taken substantially through a plane indicated by section line 6—6 in FIG. 4.
Figure 10:
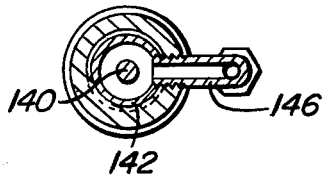
FIG. 10 is an enlarged partial sectional view taken substantially through a plane indicated by section line 10—10 in FIG. 6.

As more clearly seen in FIG. 6, the retracting element 138 is connected to the end of a piston rod 140 projecting forwardly from an ink transfer mechanism in the form of an air cylinder device 142 anchored to the bracket 114. The retracting element 138 and piston rod 140 are biased to a release position by means of a spring 144 reacting between the bracket 114 and the retracting element 138 in order to permit the ink storage housing 104 to be displaced by its springs 118 to the extended position determined by the limit stop 126. Ordinarily, air under pressure is supplied to the fluid cylinder device 142 in order to hold the housing 104 and the element 138 in the retracted position. Pressurized air is supplied to the cylinder device 142 for this purpose through a T-fitting 146 as more clearly seen in FIG. 10.

The air supply fitting 146 as more clearly seen in FIG. 2, is also connected to a flexible supply conduit 148 to which a nozzle device 150 is connected. As more clearly seen in FIG. 5, the nozzle device 150 is held in its operative position by means of a bracket 152 mounted on the hub portion 70 of the carrier arm 50. The nozzle device 150 is positioned by its bracket 152 so as to direct a stream of air at a downward incline onto the web 16 just forwardly of the marking apparatus in the direction of web travel for the purpose of drying the ink imprinted thereon by the marking apparatus. Pressurized air is supplied to the nozzle device for drying purposes simultaneously with the supply of pressurized air to the cylinder device 142 for holding the ink storage housing 104 in its retracted position. The supply of pressurized air to both the air drying nozzle device 150 and the fluid operated retracting element 138 is cut off in order to momentarily terminate the drying action while momentary ink transfer occurs between the ink storage device and a print face 100.

Figure 11:
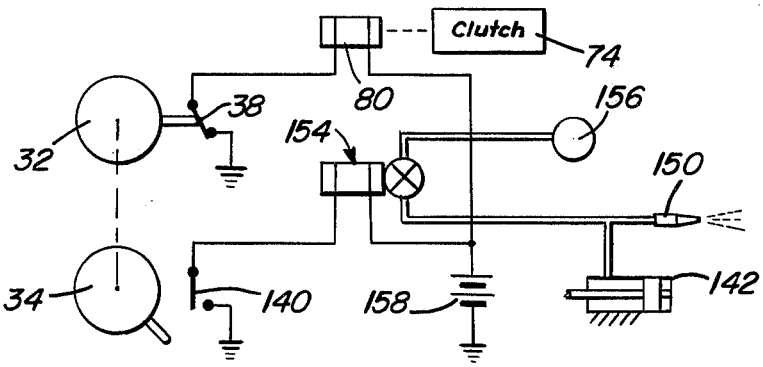
FIG. 11 is a simplified circuit diagram showing the control system associated with the marking apparatus.

Supply of air to the nozzle device 150 and the fluid operated cylinder device 142 is controlled by a solenoid operated valve 154 as diagrammatically shown in FIG. 11, the pressurized air being received from a suitable source 156. Operation of the solenoid valve is signal controlled through the switch 40 aforementioned when actuated by the actuator cam 34 in proper sequential relation to actuation of the other switch 38 by the cam 32. The switch 38 transmits signal energy to the clutch actuating solenoid 80 for operation of the clutch mechanism 74 during the limited web-loading interval as aforementioned. Signal energy for operation of the clutch solenoid 80 and solenoid valve 154 is supplied from any suitable source 158 as diagrammed in FIG. 11. Since the switch actuating cams 32 and 34 are driven with the rollers 24 and 26 advancing the web, they will actuate the signal transmitting switches 38 and 40 in timed relationship to movement of the web. The cams are angularly positioned relative to each other in order to actuate their associated switches in proper sequence for effecting momentary ink transfer between the ink storage device and a print head 98 in its rest position during inking interval followed by angular displacement of the rotatable marking element for momentary marking contact with the web.

The foregoing is considered as illustrative only of the principles of the invention. Further, since numerous modifications and changes will readily occur to those skilled in the art, it is not desired to limit the invention to the exact construction and operation shown and described, and accordingly all suitable modification and equivalents may be resorted to, falling within the scope of the invention.

What is claimed as new is as follows:

1. In combination with a moving web, a rotary marking device adapted to mark the web by rolling contact therewith at spaced locations along the direction of travel thereof, including a print head, means rotatably mounting the print head for angular displacement from a rest position along a predetermined path establishing contact with the web, drives means powered by the movement of the web connected to said mounting means and including means for selectively and intermittently causing the displacement of the print head along said path to establish momentary contact with the web, an ink storing device for transferring ink to the print head when in contact therewith, means mounting the ink storing device for displacement between a retracted position and an extended position contacting the print head in the rest position thereof, and ink transfer control means for momentarily displacing the ink storing device to said extended position prior to said displacement of the print head from the rest position whereby the drag imposed on the web by the print head during printing contact is minimized.

2. The combination of claim 1 including signal operated control means connected to the drive means for synchronizing said displacements of the print head and the ink storing device with movement of the web.

3. The combination of claim 2 including nozzle means rendered operative to direct a stream of drying fluid onto the web forwardly of the print head in said direction of travel, and valve means for rendering the nozzle means inoperative during displacement of the ink storing device to the extended position thereof.

4. The combination of claim 3 wherein said ink transfer means comprises spring means continuously biasing the ink storing device to the extended position, releasable retaining means for holding the ink storing device in said retracted position against the bias of said spring means, a source of fluid under pressure, and fluid operated means connected to said source for releasing the retaining means.

5. The combination of claim 4 wherein said valve means is connected to the source for simultaneous supply of the fluid to the nozzle means and the fluid operated means.

6. The combination of claim 5 including a second print head carried by said rotatable mounting means in angularly spaced relation to the first mentioned print head for alternate contact with the web and with the ink storing device.

7. The combination of claim 6 wherein said drive means includes a friction wheel in continuous contact with the web, and signal operated means coupling the friction wheel to the rotatable mounting means for limited angular displacement during marking cycles.

8. The combination of claim 7 wherein said signal operated control means includes signal transmitting switch means connected to the coupling means and the valve means for sequentially rendering the drive means and the ink transfer means operative during spaced intervals of time.

9. The combination of claim 2 wherein said signal operated control means includes signal transmitting switch means for sequentially rendering the drive means and the ink transfer means operative during spaced intervals of time.

10. The combination of claim 1 including nozzle means rendered operative to direct a stream of drying fluid onto the web forwardly of the print head in said direction of travel, and valve means for rendering the nozzle means inoperative during displacement of the ink storing device to the extended position thereof.

11. The combination of claim 10 wherein said ink transfer means comprises spring means continuously biasing the ink storing device to the extended position, releasable retaining means for holding the ink storing device in said retracted position against the bias of said spring means, a source of fluid under pressure, and fluid operated means connected to said source for releasing the retaining means.

12. The combination of claim 11 wherein said valve means is connected to the source for simultaneous supply of the fluid to the nozzle means and the fluid operated means.

13. The combination of claim 1 wherein said ink transfer means comprises spring means continuously biasing the ink storing device to the extended position, releasable retaining means for holding the ink storing device in said retracted position against the bias of said spring means, a source of fluid under pressure, and fluid operated means connected to said source for releasing the retaining means.

14. The combination of claim 1 including a second print head carried by said rotatable mounting means in angularly spaced relation to the first mentioned print head for alternate contact with the web and with the ink storing device.

15. The combination of claim 3 wherein said drive means includes a friction wheel in continuous contact with the web, and signal operated means coupling the friction wheel to the rotatable mounting means for limited angular displacement during marking cycles.

16. The combination of claim 15 wherein said signal operated control means includes signal transmitting switch means connected to the coupling means and the valve means for sequentially rendering the drive means and the ink transfer means operative during spaced intervals of time.

17. The combination of claim 1 wherein said drive means includes a friction wheel in continuous contact with the web, and signal operated means coupling the friction wheel to the rotatable mounting means for limited angular displacement during marking cycles.

18. In combination with a moving web, a rotary print head, web driven means rendered operative to displace said print head into momentary contact with the web and ink supply means engageable with the print head for inking the same preceding said momentary contact; signal-controlled means intermittently connecting the web driven means to transmit drive from the web to the print head for effecting said momentary contact during web-loading intervals of limited duration, ink transfer means connected to the ink supply means for momentarily effecting said engagement of said ink supply means with the print head, and automatic control means connected to the transfer means for limiting said momentary engagement to inking intervals immediately preceding each of the web-loading intervals to insure imprinting of the web without simultaneous loading thereof by the signal-controlled means and the ink transfer means.

* * * * *